US005398608A

United States Patent [19]

Kobayashi

[11] Patent Number: 5,398,608

[45] Date of Patent: Mar. 21, 1995

[54] PLATE CYLINDER FOR PRINTING PRESS

[75] Inventor: Haruyoshi Kobayashi, Yokohama, Japan

[73] Assignee: Tokyo Kikai Seisakusho, Ltd., Tokyo, Japan

[21] Appl. No.: 188,995

[22] Filed: Jan. 31, 1994

[30] Foreign Application Priority Data

May 24, 1993 [JP] Japan ..... 5-031819 U

[51] Int. Cl.[6] ..... B41F 21/12; B41F 21/14

[52] U.S. Cl. ..... 101/415.1; 101/DIG. 36

[58] Field of Search ..... 101/378, 382.1, 383, 101/415.1, DIG. 36

[56] References Cited

U.S. PATENT DOCUMENTS

| | | | |
|---|---|---|---|
| 4,831,931 | 5/1989 | Jeschke et al. | 101/415.1 |
| 5,211,112 | 5/1993 | Tsushima et al. | 101/415.1 |
| 5,218,907 | 6/1993 | Komori et al. | 101/415.1 |
| 5,299,498 | 4/1994 | Spiegel et al. | 101/415.1 X |

FOREIGN PATENT DOCUMENTS

| | | | |
|---|---|---|---|
| 3019595 | 11/1981 | Germany | 101/415.1 |
| 53-17409 | 2/1978 | Japan . | |
| 0014958 | 1/1984 | Japan | 101/415.1 |
| 61-116546 | 6/1986 | Japan . | |
| 0258753 | 11/1986 | Japan | 101/415.1 |
| 3-18183 | 4/1991 | Japan . | |
| 3-49880 | 10/1991 | Japan . | |

*Primary Examiner*—Edgar S. Burr
*Assistant Examiner*—Christopher A. Bennett
*Attorney, Agent, or Firm*—Armstrong, Westerman, Hattori, McLeland & Naughton

[57] ABSTRACT

A plate cylinder for a printing press having mounting apparatus for mounting sheet type printing plates on such plate cylinder, such plate cylinder having grooves extending in parallel to each other and parallel to the axis of such plate cylinder on the outer circumferential surface of such cylinder, such mounting apparatus including side edge positioning members for engagement in said grooves for engaging side edge reference on a sheet type printing plate to be mounted on such plate cylinder and slit positioning members for engagement in said groove for engaging slits formed in end portions of a sheet type printing plate to be mounted on such plate cylinder.

3 Claims, 2 Drawing Sheets

PLATE CYLINDER FOR PRINTING PRESS

BACKGROUND OF THE INVENTION

1. Field of the Invention

This invention relates to a plate cylinder for a printing press, and more particularly to a plate cylinder having a positioning means used when a printing plate is set.

2. Description of the Prior Art

Conventional plate cylinders having a positioning means used when a printing plate for a printing press is set include plate cylinders disclosed in, for example, Japanese Patent Laid-Open Nos. 17409/1978 and 116546/1986 and Japanese Utility Model Publication Nos. 18183/1991 and 49880/1991.

Both of the plate cylinders disclosed in Japanese Patent Laid-Open 116546/1986 and Japanese Utility Model Publication No. 18183/1991 have a positioning means provided with a reference surface for aligning a side end of a printing plate therewith, and are capable of positioning a printing plate, when it is set in a printing press, by aligning a side end of the printing plate with the reference surface.

Both of the plate cylinders disclosed in Japanese Patent Laid-Open No. 17409/1978 and Japanese Utility Model Publication No. 49880/1991 are capable of positioning a printing plate when it is set, by engaging a predetermined recess formed in the printing plate with a locking portion of the plate cylinder.

These prior art plate cylinders for printing presses are provided with a reference surface as a positioning means used when a printing plate is set, and a means for aligning a slide end of a printing plate with the reference surface; or a locking portion and a means for engaging a recess in the printing plate with the locking portion. Therefore, these plate cylinders are inconvenient in that a user cannot change the printing plate positioning specifications freely.

When the user's printing plate positioning specifications are changed for unavoidable reasons, a plate cylinder in use has to be subjected to an additional complicated machining process, such as a boring process or a positioning means providing process for the modification thereof. In order to carry out such an additional machining process, it is necessary in some cases that a large-scale operation, such as an operation for removing a plate cylinder from a printing press be carried out.

SUMMARY OF THE INVENTION

The present invention aims at providing a plate cylinder which solves the above-mentioned problems at once which are encountered in the prior art plate cylinder, and which allows a printing plate positioning means, which is mused when a printing plate is set in a printing press, to be replaced and set very easily in accordance with the user's altered printing plate positioning specifications.

The plate cylinder for a printing press according to the present invention is provided in its outer circumferential surface with grooves extending in parallel with the axis of the plate cylinder, in which grooves means for setting sheet type printing plates on the plate cylinder are provided, mount portions for side edge reference positioning members having reference surfaces with which a side edge of a sheet type printing plate to be set on the plate cylinder is engageable, and mount portions for slit reference positioning members having locking portions engageable with a slit formed in an end portion of a sheet type printing plate being provided in predetermined parts of the grooves mentioned above.

The side edge reference positioning members and slit reference positioning members are selectively set on the mount portions.

In this plate cylinder for a printing press, either the side edge reference members provided with reference surfaces for aligning a side edge of a printing plate therewith or the slit reference members provided with locking portions engageable with a slit provided in a printing plate are set on predetermined mount portions of the plate cylinder set on a printing press in accordance with the positioning specifications of the printing plates, whereby printing plate positioning specifications are satisfied.

When the specifications of a printing plate are changed, positioning members matching the positioning specifications of a newly-set printing plate are set on predetermined mount portions, and the positioning members matching the positioning specifications of the formerly-set printing plate are removed, whereby new printing plate positioning specifications are satisfied.

The above and other objects, features and advantages of the present invention will become apparent from reading of the following description which has been made in connection with the accompanying drawings.

BRIEF DESCRIPTION OF THE DRAWINGS

The present invention is illustrated in the following drawings in which:

FIG. 1(*b*) is a partial Section view, taken at b—b, FIG. 1(*a*);

FIG. 1(*c*) is a partial Section view, taken at c—c, FIG. 1(*a*);

FIG. 2(*b*) is a plan view of the positioning member of FIG. 2(*a*);

FIG. 3(*b*) is a plan view of a slit positioning member of FIG. 3(*a*);

FIG. 4(*b*) is a plan view of one auxiliary member of FIG. 4(*a*);

FIG. 5(*b*) is a plan view of another auxiliary member of FIG. 5(*a*);

FIG. 6(*b*) is a perspective view of a slit reference type printing plate for use in the instant invention.

DESCRIPTION OF THE PREFERRED EMBODIMENTS

The plate cylinder for a printing press in an embodiment of the present invention will now be described with reference to the present invention.

Figure 1:
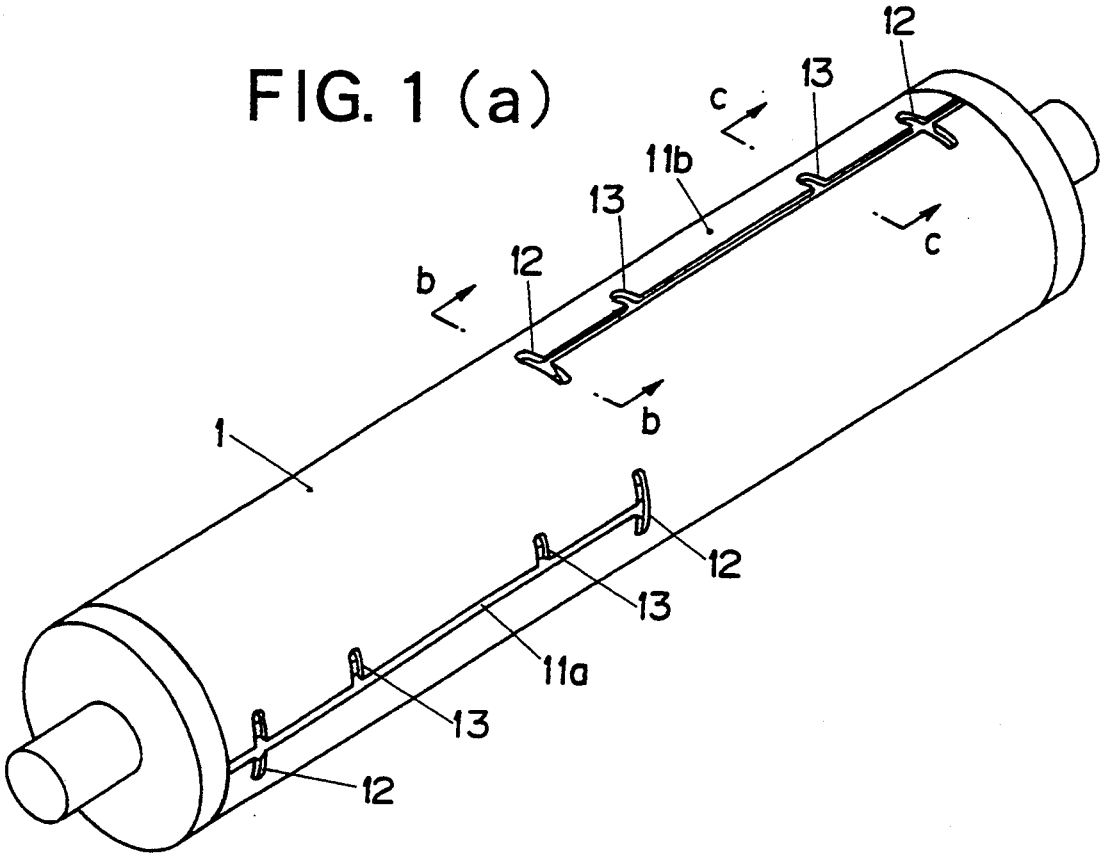
FIG. 1(*a*) is a perspective view of a plate cylinder of an embodiment of the present invention.
Figure 1:
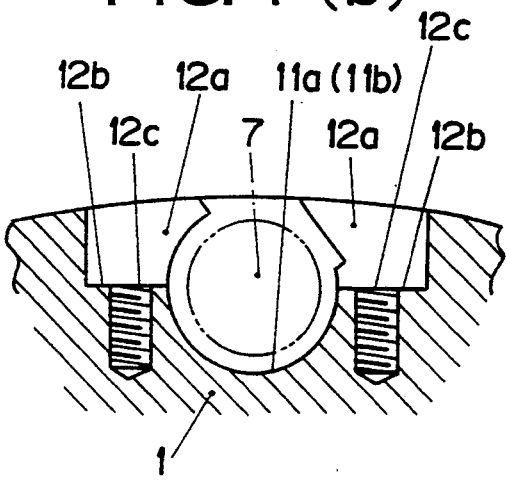
Figure 1:
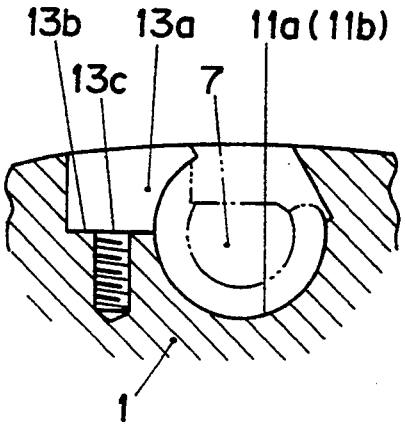

Referring to FIGS. 1(*a*)~(*c*), the outer circumferential surface of a plate cylinder 1 is provided with grooves 11*a*, 11*b* extending from both ends of the plate cylinder 1 toward a central portion thereof and in parallel with the axis of the plate cylinder so that the phases of the grooves 11*a*, 11*b* are staggered substantially 90°, and known printing plate setting means 7 for gripping the front and rear edges of printing plates in a tensed state are inserted in these grooves 11*a*, 11*b*.

Figure 6:
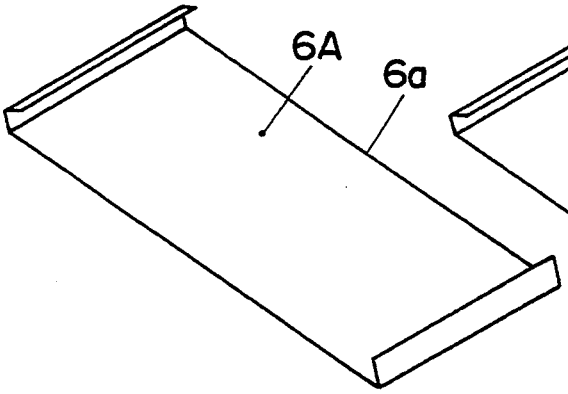
FIG. 6(*a*) is a perspective view of a side edge reference type printing plate for use in the instant invention.
Figure 6:
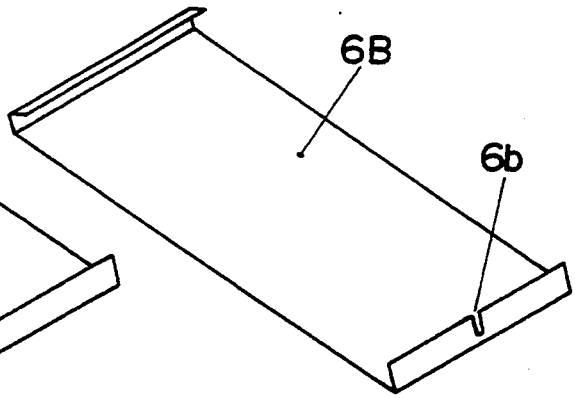

A printing plate 6A shown in FIG. 6(*a*) or a printing plate 6B shown in FIG. 6(*b*) is wound around the outer circumferential surface of the plate cylinder 1, and fixed thereto in a tensed state by the known printing plate setting means 7. Since the printing plate setting means 7 do not have direct relation with the present invention, the detailed illustration and description thereof are omitted.

It is necessary that the printing plates 6A, 6B be set in predetermined portions of the outer circumferential surface of the plate cylinder 1 with respect to the axial direction thereof so that a registration can be carried out efficiently when the lap printing such as the color printing of an original is done. Accordingly, the plate cylinder 1 is provided with means for positioning the printing plates 6A, 6B fixedly.

In the plate making in which images are formed on a printing plate, a predetermined portion of the printing plate is used as a reference portion. In general, a side edge 6*a* is used as a reference portion without providing a slit in a so-called gripping end of the printing plate 6A as shown in FIG. 6(*a*), or a precisely-formed slit 6*b* provided in a so-called gripping end of the printing plate 6B as shown in FIG. 6(*b*). Therefore, the plate cylinder 1 is provided, as a printing plate positioning means, with a reference surface with which to align the side edge 6*a*, which constitutes a reference of the side edge reference type printing plate 6A, or a locking portion engageable With the slit 6*b* which constitutes a reference of the slit reference type printing plate 6B.

In the illustrated embodiment, mount portions 12, 13 shown in FIGS. 1(*a*)~(*c*) for positioning members are provided precisely in the grooves 11*a*, 11*b* in the plate cylinder 1.

The mount portions 12 for side edge positioning members 2 are provided in a predetermined position in at least one end portion or in the vicinity of this end portion of each of the grooves 11*a*, 11*b*.

The mount portions 13 for slit positioning members 3 are provided in predetermined intermediate positions in the grooves 11*a*, 11*b*.

The mount portions 12 consist of short grooves 12*a* formed in the portions of the outer circumferential surface of the plate cylinder 1 which are on both sides of the grooves 11*a*, 11*b* so as to extend at right angles thereto. The grooves 12*a* have stepped portions 12*b*, 12*b*, in which screw holes 12*c* are provided.

The mount portions 13 consist of short grooves 13*a* formed in the portions of the outer circumferential surface of the plate cylinder 1 which are on one side of the grooves 11*a*, 11*b*. The grooves 13*a* has stepped portions 13*b*, in which screw holes 13*c* are provided.

Figure 2:
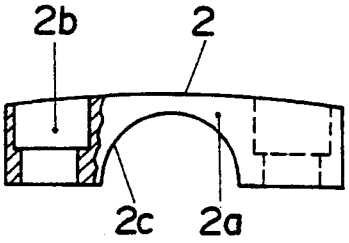
FIG. 2(*a*) is a front elevation view of a side edge positioning member for use in the present invention.
Figure 2:
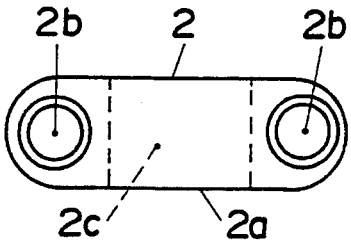

A side surface of a side edge positioning member 2 constitute a reference surface 2*a* as shown in FIGS. 2(*a*) and 2(*b*) which is engageable with the side edge 6*a* of the printing plate 6A, and this positioning member 2 consists of a piece-like member which can be fitted firmly at both end portions thereof, in which the bolt holes 2*b*, 2*b* are provided, in the grooves 12*a*, and which has in its central lower surface an arcuate recess 2*c* for the printing plate setting means 7.

Figure 3:
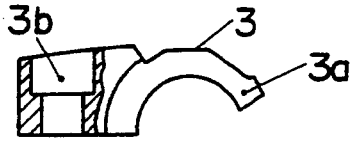
FIG. 3(*a*) is a partially sectioned front elevation view of a slit positioning member for use in the instant invention.
Figure 3:
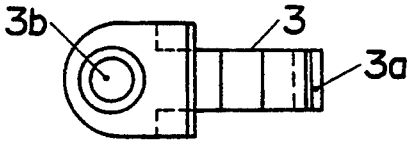

A slit positioning member 3 consists of a piece-like member in which one end portion of the side edge positioning member 2 is removed, as shown in FIGS. 3(*a*) and 3(*b*). The slit positioning member 3 can be fitted firmly at an end portion thereof, in which a bolt hole 3*b* is provided, in the groove 13*a*, and a locking portion 3*a* is narrower than this end portion and can be engaged with the slit 6*b* in the printing plate 6B.

In order to set the printing plate 6A (6B) on the plate cylinder 1, the side edge positioning members 2 are set in the mount portions 12, or the slit positioning members 3 are set in the mount portions 13, in accordance with the positioning specifications for the printing plate 6A (6B) to be used.

Namely, when the printing plate to be used has a reference side edge 6*a*, i.e., when it consists of a side edge reference type printing plate 6A, both end portions of the side edge positioning members 2 are inserted into the grooves 12*a*, 12*a* in the mount portions 12, and bolts inserted in the bolt holes 2*b* are driven into the screw holes 12*c* to set the side edge positioning members 2.

When the printing plate to be used has a reference slit 6*b*, i.e., when it consists of a slit reference type printing plate 6B, an end portion of the slit positioning members 3 is inserted into the grooves 13*a* in suitable mount portions 13, and bolts inserted in the bolt holes 3*b* are driven into the screw holes 13*c* to set the slit positioning members 3.

Figure 4:
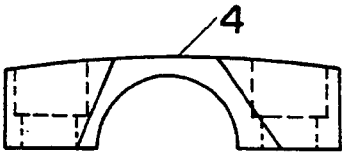
FIG. 4(*a*) is a front elevation view of one auxiliary member for use in the instant invention.
Figure 4:
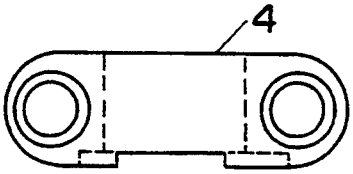
Figure 5:
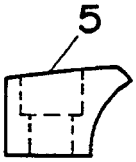
FIG. 5(*a*) is a front elevation view of another auxiliary member for use in the instant invention.
Figure 5:
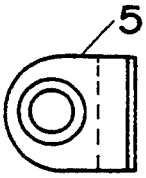

In both of these cases, first auxiliary members 4, which are formed by removing the reference surface portions from the side edge positioning members 2 shown in, for example, FIGS. 4(*a*) and 4(*b*), or second auxiliary members 5, which are formed by removing the locking portions from the slit positioning members 2 shown in FIGS. 5(*a*) and 5(*b*), i.e. the auxiliary members 4 (5) which suit the mount portions 13 (12) are set in the same manner as the positioning members to prevent the occurrence of inconvenience is in a printing operation and protect the mount portions 13 (12).

A suitable material, for example, "Bero Metal" (commercial name) is packed in the recesses left in the outer circumferential surface of the plate cylinder after the side edge positioning members 2 or slit positioning members 3, and the first auxiliary members 4 or second auxiliary members 5 have been set.

In order to change the positioning members in accordance with the alteration of the positioning specifications of the printing plates 6A, 6B, the side edge positioning members 2 or slit positioning members 3 matching the previously-used specifications are removed, and the first auxiliary members 4 or second auxiliary members 5 matching the relative mount portions 12 or 13 are set therein. The first or second auxiliary members 4 or 5 which have theretofore protected the mount portions 12 or 13 are then removed from the remaining mount portions 12 or 13 which have to be subjected to the alteration of the positioning members, and the side edge positioning members 2 or slit positioning members 3 matching the altered specifications are set in the mount portions.

The recesses left in the outer circumferential surface of the plate cylinder 1 after the side edge positioning members 2 or slit positioning members 3, and first or second auxiliary members 4 or 5 have been set in the mount portions are treated in the same manner as mentioned above.

In the plate cylinder for a printing press according to the present invention, a positioning means for setting a printing plate thereon which meets the user's requirements can be provided very simply, so that a practice of forcing users one-sidedly to follow the predetermined printing plate positioning specifications can be prevented.

Moreover, even when the printing plate positioning specifications are altered suddenly, the positioning means for setting a printing plate on a plate cylinder can be changed in much shorter time than a prior art positioning means so as to meet the new positioning requirements instantly. Therefore, a decrease in the productivity due to the stoppage of a printing press can be minimized.

While the present invention has been described above with respect to typical preferred embodiments thereof, it should of course be understood that it should not be limited only to them but various changes or modifications may be made without departure from the scope of the invention as defined by the appended claims.

What is claimed is:

1. The combination comprising: a plate cylinder for a printing press having grooves extending in parallel with the axis of said plate cylinder provided in the outer circumferential surface thereof, and means for positioning sheet type printing plates at least one of which printing plates is one having a side edge for reference or one having a slit formed in an end portion for reference, including: means for setting the sheet type printing plate on said plate cylinder, side edge positioning members having means thereon for engaging side edge reference positions of a printing plate having a side edge reference thereon, slit positioning members having means thereon for engaging slit reference positions of a printing plate having a reference slit therein, means for releasably mounting side edge positioning members in said grooves adjacent ends thereof and means for releasably mounting slit positioning members in said grooves intermediate of ends thereof.

2. The combination according to claim 1 in which said side edge positioning members include a body installed in said groove in overlying relation to said printing plate setting means, a recess on the lower surface of said body to accommodate said printing plate setting means, and holes on opposite sides of said recess to receive attaching bolts, said grooves being formed to firmly receive said side edge positioning member body and having oppositely spaced threaded openings for releasably connecting said attaching bolts.

3. The combination according to claim 1 in which said slit positioning members include a body installed in said groove and having a locking portion engageable with said slit in overlying relation to said printing plate setting means, a hole in said body positioned oppositely of said locking member to receive an attaching bolt, said grooves being formed to firmly receive said slit positioning member body and having a thread opening for releasably connecting said attaching bolt.

* * * * *